United States Patent [19]

Sutton et al.

[11] Patent Number: 4,601,081

[45] Date of Patent: Jul. 22, 1986

[54] DISPOSABLE UTENSIL FOR CLEANING AND DISINFECTING TOILET SEATS AND OTHER ARTICLES

[76] Inventors: Raymond K. Sutton; Reba A. Kelly, both of 2738 N. Talbott Ave., Indianapolis, Ind. 46205

[21] Appl. No.: 657,175

[22] Filed: Oct. 3, 1984

[51] Int. Cl.[4] ..... A47L 13/17

[52] U.S. Cl. ..... 15/104.94; 15/210 R

[58] Field of Search ..... 15/104.93, 104.94, 209 R, 15/209 D, 210 R, 244 R, 244 B, 244 C

[56] References Cited

U.S. PATENT DOCUMENTS

| | | | |
|---|---|---|---|
| 2,755,497 | 7/1956 | Greacer | 15/104.94 |
| 3,112,219 | 11/1963 | Politzer | 15/104.94 |
| 3,377,643 | 4/1968 | Teng | 15/244 R |
| 3,447,181 | 6/1969 | Coker | 15/104.94 |
| 3,463,302 | 8/1969 | Preston | 15/104.94 X |
| 3,737,939 | 6/1973 | Jones | 15/104.94 |
| 4,135,274 | 1/1979 | Freeman | 15/244 R |
| 4,252,454 | 2/1981 | Brenner | 15/210 R |
| 4,299,005 | 11/1981 | Brown | 15/104.94 X |
| 4,475,836 | 10/1984 | Colognori | 15/244 R |
| 4,493,124 | 1/1985 | Agapiou | 15/104.94 |

*Primary Examiner*—Chris K. Moore

*Attorney, Agent, or Firm*—Willian, Brinks, Olds, Hofer, Gilson & Lione

[57] ABSTRACT

A disposable utensil particularly designed for cleaning and disinfecting toilet seats in public restrooms prior to their use. The utensil comprises a pad means impregnated with a cleaning and disinfecting liquid mounted to one end of a handle means. At least the pad means portion of the utensil is encased in an air-tight covering means so that the utensil may be stored until ready for use. The utensil is approximately six inches in total length, so that it may easily be kept in a purse, automobile glove compartment, or other convenient location until needed. When needed, the covering means is removed; the utensil is used and then discarded. According to an alternative embodiment, the utensil includes two pad means: one impregnated with a liquid for cleaning and disinfecting toilet seats or other articles, the other left dry for drying the toilet seat or other article after it has been cleaned. If desired, the pad means may be formed with a curved surface configured to the surface of a toilet seat. The utensil is low in cost, and, therefore disposable after one use; compact in size, and, thus, easily stored; and highly effective in cleaning and disinfecting toilet seats and other articles.

12 Claims, 5 Drawing Figures

DISPOSABLE UTENSIL FOR CLEANING AND DISINFECTING TOILET SEATS AND OTHER ARTICLES

BACKGROUND OF THE INVENTION

The present invention relates generally to cleaning apparatus, and, more particularly, to an inexpensive, disposable utensil for cleaning and disinfecting toilet seats and other articles.

Restaurants, service stations, and many other businesses provide public restrooms for the convenience of their customers. Similarly, restrooms are usually made available to travellers in highway rest areas, in airports and bus terminals, and in various other public facilities.

Often, these restrooms are not very well maintained and are visibly dirty and insanitary. Even when a public restroom appears to be relatively clean, many people are quite hesitant to use it, fearing the possible spread of disease.

Prior to using a public restroom, many people attempt to clean the toilet seat by using a paper towel or the like. This approach is not particularly effective, nor is it very convenient. Some establishments provide paper toilet seat covers for the convenience of the user. These are not very common; and in any event, the covers are not very comfortable.

SUMMARY OF THE INVENTION

In accordance with the present invention, a utensil is provided which can conveniently be used to clean and disinfect a toilet seat or other article prior to its being used. The utensil, according to the invention, comprises an absorbent pad mounted to a short handle. The pad is impregnated with an appropriate cleaning liquid, and at least the pad portion of the utensil is then encased in a suitable air-tight covering means so that it will be available for immediate use when needed.

When it is desired to use the utensil, for example, prior to using a public toilet, it is only necessary to remove the air-tight covering means, grasp the utensil by its handle, and then wipe the pad across the surface of the toilet seat one or more times until it is satisfactorily cleaned.

The utensil is designed to be low in cost so that it can be used once and then thrown away. It is also small in size, preferably no more than about six inches in total length and about three inches in width, so that it can be easily stored in an automobile glove compartment, a purse, a briefcase, or in some other convenient location until needed.

The pad can be made of a variety of materials capable of absorbing and retaining a liquid such as a plurality of layers of absorbent paper or cloth or a suitable, sponge-like, plastic material.

The cleaning liquid preferably comprises a liquid that will both clean and disinfect; and any one of a number of commercially available products including PINE-SOL Cleaner and Disinfectant, marketed by American Cynanmid, and LYSOL brand Deodorizing Cleaner, marketed by Sterling Drug Co., can be used. Alcohol used alone or mixed with a compatible detergent or another cleaning agent can also be used as the cleaning liquid if desired. An alcohol-based liquid, in particular, has the advantage that it will dry rapidly after being applied to the toilet seat so that the toilet may be used immediately after cleaning.

The handle can be formed of wood, plastic, a paper-based material, or some other substantially rigid, inexpensive material, and can be attached to the pad by an adhesive, by stapling, or by various other securing means for attaching the pad to the handle in a substantially permanent manner.

The covering means preferably comprises a plastic shrink wrap or an air-tight, coated, paper envelope surrounding either the pad or the entire utensil.

According to an alternative embodiment, the utensil may be provided with two pads mounted to the handle in back-to-back relationship with respect to one another. One of the pads is impregnated with a cleaning and disinfecting solution, while the other pad is left dry. With this embodiment, the impregnated pad can first be wiped across the surface of the toilet seat one or more times to clean and disinfect the seat; and thereafter, the other pad can be used to dry the seat for use.

With either embodiment, the pads can be provided with a curved surface, if desired, so that they will generally conform to the shape of a standard toilet-seat surface. In this way, substantially the entire surface of the toilet seat can be cleaned or dried with only one sweep of the pad around the seat.

The utensil, according to the present invention, is low in cost and, therefore, readily disposable after one use; compact in size and, therefore, convenient to store until needed; and yet highly effective in cleaning and disinfecting toilet seats and other articles in a bathroom or elsewhere.

Further details of the invention will be set out hereinafter in conjunction with the detailed description of the preferred embodiment.

DETAILED DESCRIPTION OF THE PREFERRED EMBODIMENTS

Figure 1:
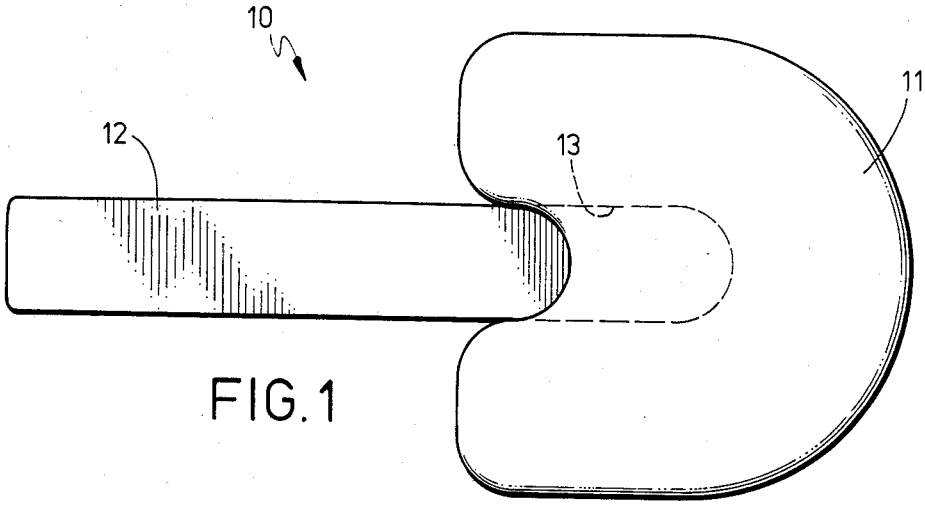
FIG. 1 illustrates a utensil for cleaning and disinfecting toilet seats or other articles according to a presently preferred embodiment of the invention.
Figure 2:
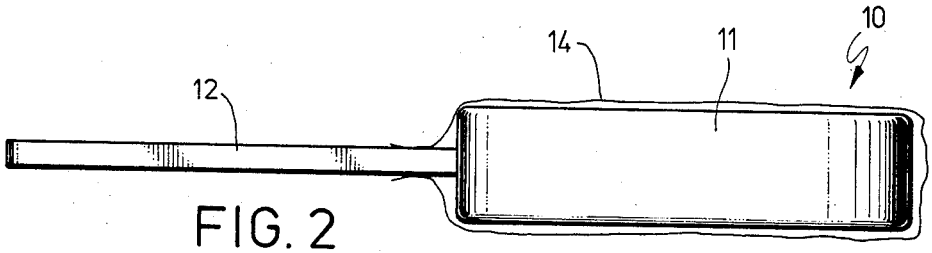
FIG. 2 illustrates a side view of the utensil of FIG. 1.

FIGS. 1 and 2 illustrate a utensil particularly designed for use in cleaning and disinfecting toilet seats according to one embodiment of the invention. The utensil is generally designated by reference numeral 10 and comprises a pad 11 mounted to one end of a handle 12. Pad 11 is formed of material capable of absorbing and retaining a cleaning liquid, and may comprise a pad formed of a plurality of layers of an absorbent paper or cloth or a suitable, absorbent, sponge-like, plastic material.

Pad 11 is preferably impregnated with a liquid capable of both cleaning and disinfecting a toilet seat or other article to which the utensil may be applied, and a number of commercially available products may be used including LYSOL brand Deodorizing Cleaner, marketed by Sterling Drug Co., and PINE-SOL cleaner and disinfectant marketed by American Cyanamid. Alcohol used alone or mixed with a compatible detergent or other cleaning agent can also be used, if desired. An alcohol-based liquid is particularly suitable for use in the embodiment of FIGS. 1 and 2 in that it will dry rapidly after being applied to the toilet seat so that the toilet may be used immediately after cleaning.

Handle 12 can also be formed of any inexpensive, relatively rigid material such as wood, plastic, or even a paper-based material.

The pad is preferably formed to define a cavity 13 into which one end of the handle 12 can be inserted. Attachment of the pad to the handle can be accomplished by an adhesive, by stapling, or by various other known securing means for attaching the pad to the handle in a substantially permanent manner.

In the preferred embodiment, the pad is approximately three inches long by about three inches wide and about one-half to three-quarters inch thick, while the handle 12 extends from the pad for a distance of about three inches to provide a utensil that is about six inches in total length. An article of this size can be easily stored in a woman's purse, in the glove compartment of an automobile, in a briefcase, or in many other convenient locations until needed.

In order to keep the pad moist and ready for immediate use, it is necessary that at least the pad portion of the utensil be encased within an air-tight covering means. In FIG. 2, a plastic shrink wrap 14 is shown as surrounding the pad means 11. If desired, the shrink wrap 14 could also encase the entire utensil. An air-tight, coated, paper envelope could also be employed as a means to cover either the entire utensil or the pad, if desired.

When it is desired to use the utensil, for example, to clean a toilet seat, it is only necessary to remove the covering means, wipe across the toilet seat one or more times with the pad, and then dispose of the utensil in a nearby trash receptacle.

Figure 3:
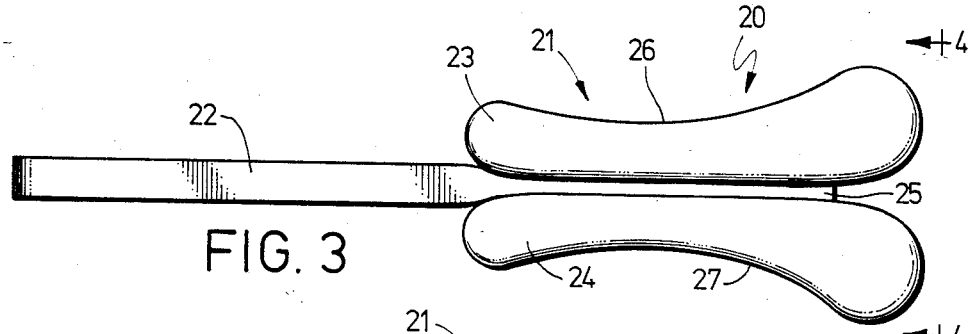
FIG. 3 illustrates a side view of an alternative embodiment of the invention.
Figure 4:
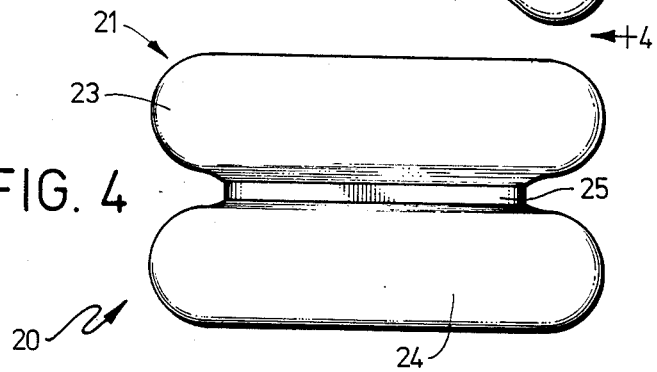
FIG. 4 illustrates the utensil of FIG. 3 looking in the direction of arrow 4—4 in FIG. 3.

FIGS. 3 and 4 illustrate an alternative embodiment of the invention. As shown in those FIGS., the utensil 20 comprises a pad means 21 attached to one end of a handle 22. In this embodiment, pad means 21 comprises two separate pads 23 and 24. One of the pads, e.g., pad 23, is adapted to be impregnated with a cleaning and disinfecting solution as in the embodiment of FIGS. 1 and 2, while the other pad, e.g., pad 24, is left dry. With this embodiment, pad 23 is first wiped across the toilet seat one or more times to clean and disinfect the seat. Thereafter, the utensil is turned around; and pad 24 is wiped across the seat to dry it.

The utensil of FIGS. 3 and 4 can be conveniently manufactured by attaching the pads 23 and 24 in back-to-back relationship on opposite sides of the handle 22 by means of an adhesive or other appropriate securing means. As best shown in FIG. 4, which is a view of the utensil of FIG. 3 looking in the direction of arrow 4—4 in FIG. 3, handle 22 is preferably formed with an extended portion 25 to which the pads 23 and 24 are attached. Portion 25 is somewhat narrower than the remainder of the handle 22 and is of generally rectangular shape to support the pads 23 and 24 of either side thereof and to prevent them from contacting one another.

Figure 5:
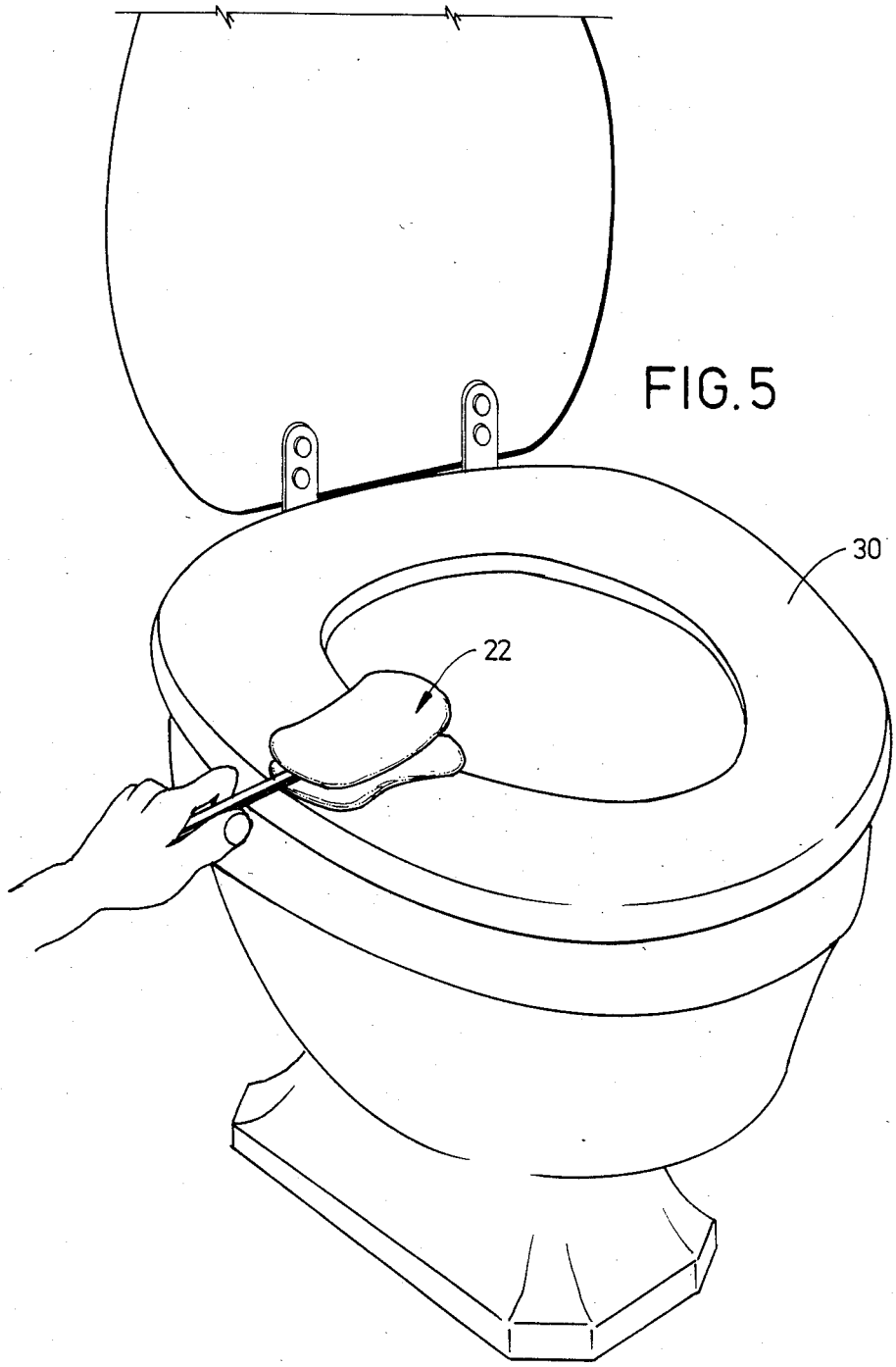
FIG. 5 illustrates the manner of using the utensil according to the present invention.

As shown in FIG. 3, pads 23 and 24 are preferably curved somewhat to provide concave surfaces 26 and 27, respectively. These pads can be configured to conform to the shape of a standard toilet seat; and in this way, substantially the entire surface of the seat can be effectively cleaned and disinfected by one wipe of pad 23 around the seat, and then dried by only one wipe of pad 24 therearound. This is illustrated in FIG. 5 wherein pad 20 is shown being used to clean a toilet seat 30.

The utensil of the present invention is very inexpensive to manufacture and, as a result, is readily disposable after one use. It is also very compact in size; and thus, one or more can easily be stored in a convenient place until needed.

A utensil of the type illustrated and described can be dispensed one at a time from a dispenser located in a public restroom for the convenience of the user. Also, it can be sold in multi-unit packages in grocery stores and other retail outlets.

Although designed primarily for use when away from home, the utensil of the present invention can also be used in the home and in commercial cleaning activities as a convenient way to clean toilet seats or other articles.

While what has been described constitutes presently most preferred embodiments of the invention, it should be recognized that the invention could take many other forms. Accordingly, it should be understood that the invention is to be limited only insofar as is required by the scope of the following claims.

We claim:

1. A disposable utensil for cleaning toilet seats and other articles, said utensil comprising:

a handle;

first and second pad means, said first pad means being impregnated with a cleaning liquid for cleaning a toilet seat or other article, and said second pad means being substantially dry for drying said toilet seat or other article after being cleaned by said first pad means;

securing means for attaching said first and second pad means to said handle in a substantially permanent manner; and removable covering means for encasing at least said first pad means in an air-tight manner for maintaining said first pad means moist and ready for substantially immediate use when needed.

2. The utensil of claim 1 wherein said covering means comprises a plastic shrink wrap enclosing at least said first pad means.

3. The utensil of claim 1 wherein said cleaning liquid comprises a cleaning and disinfecting liquid.

4. The utensil of claim 1 wherein said first and second pad means each include a concave curved outer surface substantially configured to the surface of a toilet seat.

5. The utensil of claim 4 wherein said handle includes a handle portion extending between said first and second pad means, said first and second pad means being mounted to said handle portion in back-to-back relationship on opposite sides of said handle portion, and wherein said securing means includes means for securing said first and second pad means to said handle portion in a substantially permanent manner.

6. The utensil of claim 1 wherein the total length of said utensil is approximately six inches.

7. A fully disposable utensil for cleaning and disinfecting toilet seats and other articles, said utensil comprising:

a handle;

first and second pads, said first pad being impregnated with a cleaning and disinfecting liquid and said second pad being substantially dry;

securing means for attaching said first and second pads to opposite sides of said handle adjacent an end thereof in a substantially permanent manner; and covering means for encasing at least said first and second pads in an air-tight manner.

8. The utensil of claim 7 wherein said first and second pads each include a concave curved, outer surface substantially configured to the surface of a toilet seat.

9. A disposable utensil for cleaning toilet seats and other articles, said utensil comprising:

a handle;

absorbent pad means attached to said handle, said absorbent pad means having a concave curved surface configured to the surface of a toilet seat and being impregnated with a cleaning liquid;

securing means for attaching said pad means to said handle in a substantially permanent manner; and removable covering means for encasing at least said pad means in an air-tight manner for maintaining said pad means moist and ready for substantially immediate use when needed.

10. The utensil of claim 9 wherein said securing means comprises an adhesive.

11. The utensil of claim 9 wherein said securing means comprising staple means.

12. The utensil of claim 9 wherein said pad means includes a cavity for receiving an end of said handle.

* * * * *